US010086433B2

(12) United States Patent
Kitakizaki et al.

(10) Patent No.: US 10,086,433 B2
(45) **Date of Patent: *Oct. 2, 2018**

(54) PROCESS FOR PRODUCING ELECTRODE MATERIAL, AND ELECTRODE MATERIAL

(71) Applicant: MEIDENSHA CORPORATION, Tokyo (JP)

(72) Inventors: Kaoru Kitakizaki, Saitama (JP); Keita Ishikawa, Tokyo (JP); Shota Hayashi, Tokyo (JP); Nobutaka Suzuki, Kodaira (JP)

(73) Assignee: MEIDENSHA CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/318,448

(22) PCT Filed: May 29, 2015

(86) PCT No.: PCT/JP2015/065499

§ 371 (c)(1),
(2) Date: Dec. 13, 2016

(87) PCT Pub. No.: WO2015/194344

PCT Pub. Date: Dec. 23, 2015

(65) Prior Publication Data

US 2017/0232520 A1 Aug. 17, 2017

(30) Foreign Application Priority Data

Jun. 16, 2014 (JP) ..... 2014-122964

(51) Int. Cl.
*B22F 3/26* (2006.01)
*B22F 9/04* (2006.01)
(Continued)

(52) U.S. Cl.
CPC ..... *B22F 7/008* (2013.01); *B22F 1/0014* (2013.01); *B22F 3/15* (2013.01); *B22F 3/16* (2013.01);
(Continued)

(58) Field of Classification Search
CPC ..... B22F 3/15; B22F 3/26; B22F 3/16; B22F 9/04; B22F 2301/10; B22F 2301/20;
(Continued)

(56) References Cited

U.S. PATENT DOCUMENTS 4,836,978 A 6/1989 Watanabe et al.
5,330,702 A 7/1994 Kippenberg et al.
(Continued)

FOREIGN PATENT DOCUMENTS

EP 3 106 249 A1 12/2016
JP 63-62122 A 3/1988
(Continued)

OTHER PUBLICATIONS

Rieder et al., The Influence of Composition and Cr Particle Size of Cu/Cr Contacts on Chopping Current, Contact Resistance, and Breakdown Voltage in Vacuum Interrupters, IEEE Transactions on Components, Hybrids, and Manufacturing Technology, vol. 12, No. 2, Jun. 1989, pp. 273-283.
(Continued)

*Primary Examiner* — Colleen P Dunn
*Assistant Examiner* — Anthony M Liang
(74) *Attorney, Agent, or Firm* — Foley & Lardner LLP

(57) ABSTRACT

A process for producing an electrode material by infiltrating a highly conductive metal such as Cu into a porous object containing heat-resistant elements. Before an infiltration step in which the highly conductive metal is infiltrated, a HIP treatment is given to a powder containing the heat-resistant elements (or to a molded object obtained by mold-
(Continued)

ing a powder containing the heat-resistant elements). The composition is controlled so that the HIP treatment yields a porous object which has a degree of filling of 70% or higher, more preferably 75% or higher. The highly conductive metal is infiltrated into the porous object having the controlled composition.

13 Claims, 3 Drawing Sheets

(51) Int. Cl.

| | |
|---|---|
| ***B22F 7/00*** | (2006.01) |
| ***B22F 3/15*** | (2006.01) |
| ***B22F 5/00*** | (2006.01) |
| ***C22C 1/04*** | (2006.01) |
| ***C22C 1/08*** | (2006.01) |
| ***C22C 27/04*** | (2006.01) |
| ***C22C 27/06*** | (2006.01) |
| ***B22F 1/00*** | (2006.01) |
| ***B22F 3/16*** | (2006.01) |
| ***H01H 1/02*** | (2006.01) |

(52) U.S. Cl.
CPC ..... *B22F 3/26* (2013.01); *B22F 5/00* (2013.01); *B22F 9/04* (2013.01); *C22C 1/04* (2013.01); *C22C 1/08* (2013.01); *C22C 27/04* (2013.01); *C22C 27/06* (2013.01); *H01H 1/0206* (2013.01); *B22F 2201/20* (2013.01); *B22F 2301/10* (2013.01); *B22F 2301/20* (2013.01); *B22F 2304/10* (2013.01); *B22F 2998/10* (2013.01)

(58) Field of Classification Search
CPC . B22F 7/008; B22F 3/25; C22C 1/045; C22C 1/04; C22C 1/08; C22C 27/04; C22C 27/06; H01H 1/0206
See application file for complete search history.

(56) References Cited

U.S. PATENT DOCUMENTS

| | | | |
|---|---|---|---|
| 6,551,374 | B2 | 4/2003 | Doh et al. |
| 2013/0199905 | A1 | 8/2013 | Noda et al. |
| 2015/0200059 | A1 | 7/2015 | Noda et al. |
| 2016/0369373 | A1 | 12/2016 | Kitakizaki et al. |

FOREIGN PATENT DOCUMENTS

| | | | | |
|---|---|---|---|---|
| JP | 4-505985 | A | 10/1992 | |
| JP | 05-287320 | A | 11/1993 | |
| JP | 9-194906 | A | 7/1997 | |
| JP | 2002-180150 | A | 6/2002 | |
| JP | 2004-211173 | A | 7/2004 | |
| JP | 2006-169547 | A | 6/2006 | |
| JP | WO 2011162398 | A1 * | 12/2011 | ..... C22C 1/0425 |
| JP | 2012-007203 | A | 1/2012 | |
| WO | WO-2015/133263 | A1 | 9/2015 | |
| WO | WO-2015/133264 | A1 | 9/2015 | |

OTHER PUBLICATIONS

Tanaka et al., Sintering of Advanced Materials, Applications of Hot Isostatic Pressing, 1987, p. 207, Uchida Rokakuho Publishing Co., Ltd.

USPTO Notice of Allowance, U.S. Appl. No. 15/508,256, dated Apr. 27, 2018, 9 pages.

* cited by examiner

PROCESS FOR PRODUCING ELECTRODE MATERIAL, AND ELECTRODE MATERIAL

TECHNICAL FIELD

The present invention relates to a process for producing an electrode material, and to an electrode material.

BACKGROUND OF THE INVENTION

An electrode material used for an electrode of a vacuum interrupter (VI) etc. is required to fulfill the properties of: (1) a great current-interrupting capacity; (2) a high withstand voltage capability; (3) a low contact resistance; (4) a good welding resistance; (5) a lower consumption of contact point; (6) a small interrupting current; (7) an excellent workability; (8) a great mechanical strength; and the like.

A copper (Cu)-chromium (Cr) electrode has the properties of a good current-interrupting capacity, a high withstand voltage capability; a good welding resistance and the like and widely known as a material for a contact point of a vacuum interrupter. The Cu—Cr electrode has been reported that Cr particles having a finer particle diameter are more advantageous in terms of the current-interrupting capacity and the contact resistance (for example, by Non-Patent Document 1).

As a method for producing a Cu—Cr electrode material, there are generally well two methods, i.e. a sintering method (a solid phase sintering method) and a infiltration method. In the sintering method, Cu having a good conductivity and Cr having an excellent arc resistance are mixed at a certain ratio, and the mixed powder is press molded and then sintered in a non-oxidizing atmosphere (for example, in a vacuum atmosphere) thereby producing a sintered body. The sintering method has the advantage that the composition between Cu and Cr can freely be selected, but it is higher in gas content than the infiltration method and therefore has a fear of being inferior to the infiltration method in mechanical strength.

On the other hand, in the infiltration method, a Cr powder is press molded (or not molded) and charged into a container and then heated to temperatures of not lower than the melting point of Cu in a non-oxidizing atmosphere (for example, in a vacuum atmosphere) to infiltrate Cu into airspaces defined among Cr particles, thereby producing an electrode. Although the composition ratio between Cu and Cr cannot freely be selected, the infiltration method has the advantage that a material smaller than the sintering method in gas content and the number of airspaces is obtained, the material being superior to the sintering method in mechanical strength.

In recent years, conditions for the use of the vacuum interrupter are getting restricted while the application of the vacuum interrupter to a capacitor circuit is increasingly developed. In a capacitor circuit a voltage two or three times the usual one is applied between electrodes, so that it is assumed that the surface of a contact point receives significant damages by arc generated at current-interrupting time or current-starting time thereby causing the reignition of arc easily. For example, when closing electrodes under a state of applying voltage, an electric field between a movable electrode and a fixed electrode is so strengthened as to cause an electrical breakdown before the electrodes are closed. An arc is to be generated at this time, and the surfaces of the contact points of the electrodes cause melting by the heat of the arc. After the electrodes have been closed, the melted portions are reduced in temperature by thermal diffusion so as to be welded. When opening the electrodes, the welded portions are stripped from each other and therefore the surfaces of the contact points are to be damaged. Hence there has been desired an electrode material having better withstand voltage capability and current-interrupting capability than those of the conventional Cu—Cr electrode.

As a method for producing a Cu—Cr based electrode material excellent in electrical characteristics such as withstand voltage capability and current-interrupting capability, there is a method of producing an electrode where a Cr powder for improving the electrical characteristics and a heat resistant element powder (molybdenum (Mo), tungsten (W), niobium (Nb), tantalum (Ta), vanadium (V), zirconium (Zr) etc.) for refining the Cr powder are added to a Cu powder as a base material and then the mixed powder is charged into a mold and press molded and finally obtain a sintered body (Patent Documents 1 and 2, for example).

To be more specific, a heat resistant element is added to a Cu—Cr based electrode material originated from Cr having a particle diameter of 200-300 μm, thereby refining Cr through a microstructure technique. Namely, the method is such as to accelerate the alloying of Cr and the heat resistant element and to increase the deposition of fine Cr—X particles (where X is a heat resistant element) in the interior of the Cu base material structure. As a result, Cr particles having a particle diameter of 20-60 μm is uniformly dispersed in the Cu base material structure, in the form of including the heat resistant element in the interior thereof.

As mentioned in Patent Document 2, in order to improve current-interrupting capability and withstand voltage capability, it is preferable to increase the content of Cr and that of the heat resistant element such as Mo in the Cu—Cr based electrode material and additionally it is preferable to fine the particle diameters of Cr, Mo and the like so as to uniformly disperse them. However, since the increased contents of Cr, Mo and the like decrease the conductivity of the electrode material, there comes about a drawback that the contact resistance is increased and the current-interrupting capability is reduced.

Accordingly, in order to improve the Cu—Cr based electrode material in current-interrupting capability and withstand voltage capability, it is required to increase the content of Cr and that of the heat resistant element such as Mo without lowering the conductivity of the electrode material as far as possible (or without lowering the contact resistance as far as possible).

REFERENCES ABOUT PRIOR ART

Patent Documents

Patent Document 1: Japanese Patent Application Publication No. 2012-007203

Patent Document 2: Japanese Patent Application Publication No. 2002-180150

Patent Document 3: Japanese Patent Application Publication No. 2004-211173

Patent Document 4: Japanese Patent Application Publication No. S63-062122

Patent Document 5: Japanese Patent Application Publication No. H09-194906

Non-Patent Documents

Non-Patent Document 1: RIEDER, F. u.a., "The Influence of Composition and Cr Particle Size of Cu/Cr Contacts on Chopping Current, Contact Resistance, and Breakdown Voltage in Vacuum Interrupters", IEEE Transactions on Components, Hybrids, and Manufacturing Technology; Vol. 12, 1989, 273-283

Non-Patent Document 2: "Sintering of Advanced Materials—Applications of Hot Isostatic Pressing" edited by K. Tanaka and K. Ishizaki and published by Uchida Rokakuho Publishing Co., Ltd., 1987, pp. 207

SUMMARY OF THE INVENTION

An object of the present invention is to provide an electrode material having a withstand voltage capability greater than that of conventional Cu—Cr electrode materials, and additionally, a particular object of the present invention is to improve a degree of filling of a porous material to be infiltrated with a highly conductive metal such as Cu, silver and the like in an electrode material produced by infiltration method.

In infiltration method, molding of a porous material is performed by metallic molding or the like, for example; however, when increasing a molding pressure in order to improve the porous material in degree of filling, a mold gets conspicuously worn out so as to be possibly shortened in life.

An aspect of a process for producing an electrode material according to the present invention which process can attain the above-mentioned object resides in a process for producing an electrode material, comprising the steps of: subjecting a powder containing a heat resistant element or a molded body of the heat resistant element-containing powder to a hot isostatic pressing treatment at temperatures lower than the melting point of the heat resistant element, to produce a porous body; and infiltrating the porous body with a metal having a melting point lower than that of the heat resistant element.

Additionally, another aspect of a process for producing an electrode material according to the present invention which process can attain the above-mentioned object resides in the above-mentioned process further comprising a step of sintering the powder or the molded body, wherein the powder or the molded body is subjected to the hot isostatic pressing treatment after the sintering step.

Additionally, a further aspect of a process for producing an electrode material according to the present invention which process can attain the above-mentioned object resides in the above-mentioned process wherein the metal infiltrated into the porous body is a highly conductive metal.

Additionally, a still further aspect of a process for producing an electrode material according to the present invention which process can attain the above-mentioned object resides in the above-mentioned process wherein the highly conductive metal is copper and the heat resistant element is chromium and molybdenum.

Additionally, an aspect of an electrode material according to the present invention which can attain the above-mentioned object resides in an electrode material comprising: a porous body containing a heat resistant element and having a degree of filling of not smaller than 70%; and a metal having a melting point lower than that of the heat resistant element, wherein the metal is infiltrated into the porous body.

Additionally, another aspect of an electrode material according to the present invention which can attain the above-mentioned object resides in the above-mentioned electrode material wherein the metal infiltrated into the porous body is a highly conductive metal.

Additionally, a further aspect of an electrode material according to the present invention which can attain the above-mentioned object resides in the above-mentioned electrode material wherein the highly conductive metal is copper and the heat resistant element is chromium and molybdenum.

MODE(S) FOR CARRYING OUT THE INVENTION

Figure 1:
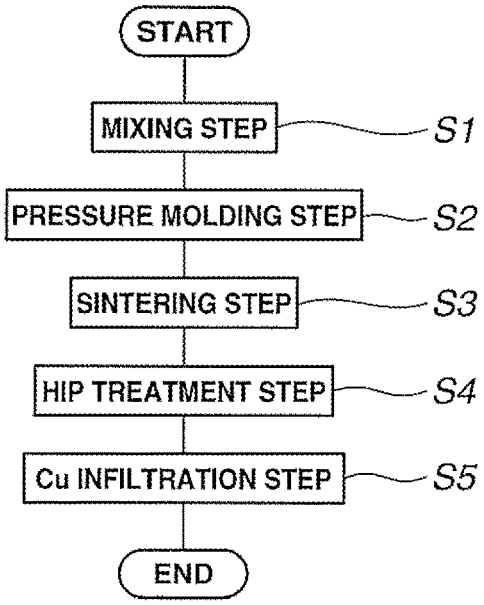
FIG. 1 A flow chart showing a process for producing an electrode material according to an embodiment of the present invention (in the case of conducting a HIP treatment step after a sintering step).

Referring now to the accompanying drawings, a process for producing an electrode material and an electrode material according to an embodiment of the present invention will be discussed in detail. In the explanations on the embodiment, an average particle diameter (also referred to as a median diameter d50, a particle diameter or the like) and a volume-based relative particle amount mean values measured by a laser diffraction particle size analyzer (available from CILAS under the trade name of CILAS 1090L) unless otherwise specified.

The present invention relates to a technique for producing an electrode material of such a composition as to include metal (Cu, Ag etc.), Cr and a heat resistant element (Mo, W, V etc.), through the infiltration method. In the infiltration method, a mixed powder containing a Cr powder and a heat resistant element powder (Mo etc.) is molded by press molding or the like and then the thus molded body is infiltrated with a highly conductive metal such as Cu and Ag, thereby producing an electrode material. Incidentally, in the infiltration method, the mixed powder is sometimes infiltrated with a metal such as Cu and Ag without being molded.

As a result of having eagerly made studies on the improvements of the electrode material in terms of the withstand voltage capability, the present inventors have found that the withstand voltage capability of an electrode material is enhanced by subjecting the heat resistant element-containing molded body to a hot isostatic pressing treatment (hereinafter referred to as a HIP treatment) before infiltrating the molded body with a highly conductive metal, thereby achieving the completion of the present invention.

As a heat resistant element, an element selected from elements including molybdenum (Mo), tungsten (W), tantalum (Ta), niobium (Nb), vanadium (V), zirconium (Zr), beryllium (Be), hafnium (Hf), iridium (Ir), platinum (Pt), titanium (Ti), silicon (Si), rhodium (Rh) and ruthenium (Ru) can be used singly or in combination. Particularly, it is preferable to use Mo, W, Ta, Nb, V and Zr which are prominent in effect of refining Cr particles. Moreover, a carbide of these heat resistant elements may be used as the heat resistant component. In the case of using a heat resistant element in the form of powder, the heat resistant element powder is provided with an average particle diameter of 2-20 μm, more preferably 2-10 μm, thereby allowing fining the Cr-containing particles (i.e., particles containing a solid solution of a heat resistant element and Cr) and uniformly dispersing them in an electrode material. If the heat resistant element has a content of 13-94 wt %, more preferably 35-92 wt % relative to the electrode material, it becomes possible to improve the electrode material in withstand voltage capability without impairing its mechanical strength, machinability and current-interrupting capability.

When Cr has a content of 0.65-76 wt %, more preferably 0.7-46 wt % relative to the electrode material, it is possible to improve the electrode material in withstand voltage capability without impairing its mechanical strength, machinability and current-interrupting capability. In the case of using Cr particles, the Cr particles are provided with a particle diameter of, for example, under-48 mesh (a particle diameter of less than 300 μm), more preferably under-100 mesh (a particle diameter of less than 150 μm), much more preferably under-325 mesh (a particle diameter of less than 45 μm), with which it is possible to obtain an electrode material excellent in withstand voltage capability and current-interrupting capability. Cr particles having a particle diameter of under-100 mesh is able to reduce the amount of a remanent Cr which can be a factor for increasing the particle diameter of Cu having been infiltrated into the electrode material. Additionally, though it is preferable to use Cr particles having a small particle diameter from the viewpoint of dispersing fined-Cr-containing particles in the electrode material, finer Cr particles are to increase the oxygen content in the electrode material more and more thereby reducing the current-interrupting capability. The increase of the oxygen content in the electrode material, brought about by decreasing the particle diameter of the Cr particles, is assumed to be caused by Cr being finely pulverized and oxidized. Hence if only it is possible to process Cr into a fine powder under a condition where Cr does not oxidize (e.g. in an inert gas), Cr particles the particle diameter of which is less than under-325 mesh may be employed. It is preferable to use Cr particles having a small particle diameter from the viewpoint of dispersing fined-Cr-containing particles in the electrode material.

As a metal to be infiltrated, it is possible to employ a highly conductive metal such as copper (Cu), silver (Ag), an alloy of Cu and Ag and the like. When these metals have a content of 5-35 wt %, more preferably 7.5-30 wt % relative to the electrode material, it is possible to enhance the withstand voltage capability of the electrode material without reducing the current-interrupting capability and without increasing the contact resistance. Incidentally, a Cu content of the electrode material is to be determined according to an infiltration step, so that the total of the heat resistant element, Cr and Cu, which are contained in the electrode material, never exceeds 100 wt %.

Referring now to a flow chart shown in FIG. 1, a process for producing an electrode material according to an embodiment of the present invention will be discussed in detail. Although the following explanations will be made by taking Mo as an example of the heat resistant element while taking Cu as an example of the highly conductive metal, similar results should be obtained even if using other heat resistant element powders or using other highly conductive metals.

In a mixing step S1, a heat resistant element powder (for example, a Mo powder) and a Cr powder are mixed. The Mo powder and the Cr powder are mixed such that the weight ratio of Cr to Mo is one or less to one, for example, thereby making it possible to produce an electrode material having good withstand voltage capability and current-interrupting capability.

In a press molding step S2, the mixed powder obtained from the Mo power and the Cr powder at the mixing step S1 (hereinafter referred to merely as a mixed powder) is subjected to press molding in use of a press machine or the like. The molding pressure applied at this step is not particularly limited but preferably 2 to 4.5 t/cm$^2$, for example.

Figure 2:
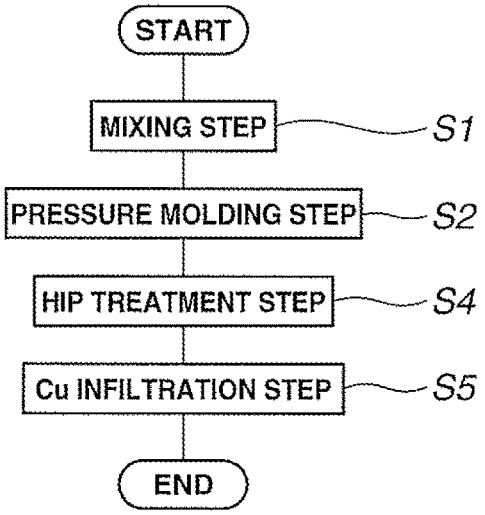
FIG. 2 A flow chart showing a process for producing an electrode material according to an embodiment of the present invention (in the case of conducting the HIP treatment step without performing the sintering step).

In a sintering step S3, the molded mixed powder is subjected to sintering, thereby obtaining a sintered body. Sintering is performed by sintering the molded body of the mixed powder at 1150° C. for 2 hours in vacuum atmosphere, for example. The sintering step S3 is a step of producing a denser Mo—Cr sintered body through deformation and bonding of the Mo powder and the Cr powder. Sintering of the mixed powder is preferably carried out under a temperature condition of the subsequent infiltration step S5, for example, at a temperature of 1150° C. or higher. This is because, if sintering is performed at a temperature lower than an infiltration temperature, gas contained in the sintered body comes to up newly at the time of infiltration and remains in an infiltrated body thereby possibly behaving as a factor for impairing the withstand voltage capability and current-interrupting capability. Consequently, the sintering temperature is higher than the infiltration temperature and not higher than the melting point of Cr, preferably ranges from 1150° C. to 1500° C. Within the above-mentioned range, densification of Mo—Cr particles is accelerated and degasification of the Mo—Cr particles is sufficiently developed. Incidentally, as shown in FIG. 2, the sintered body (or a porous body) may be obtained also by conducting a HIP treatment step S4 directly without performing the sintering step S3.

In a HIP treatment step S4, the obtained sintered body (or the molded body of the mixed powder) is subjected to a HIP treatment. The treatment temperature applied in the HIP treatment is not particularly limited insofar as it is less than the melting point of the sintered body (or that of the mixed powder). Namely, the treatment temperature and the treatment pressure applied in the HIP treatment are suitably determined according to the performances that an electrode material is required to have. For example, the HIP treatment is carried out at a treatment temperature of 700 to 1100° C., a treatment pressure of 30 to 100 MPa and a treatment time of 1 to 5 hours.

In a Cu infiltration step S5, the Mo—Cr sintered body (or porous body) having undergone the HIP treatment is infiltrated with Cu. Infiltration with Cu is performed by disposing a Cu plate material onto the sintered body and keeping it in a non-oxidizing atmosphere at a temperature of not lower than the melting point of Cu for a certain period of time (e.g. at 1150° C. for two hours), for example.

Figure 3:
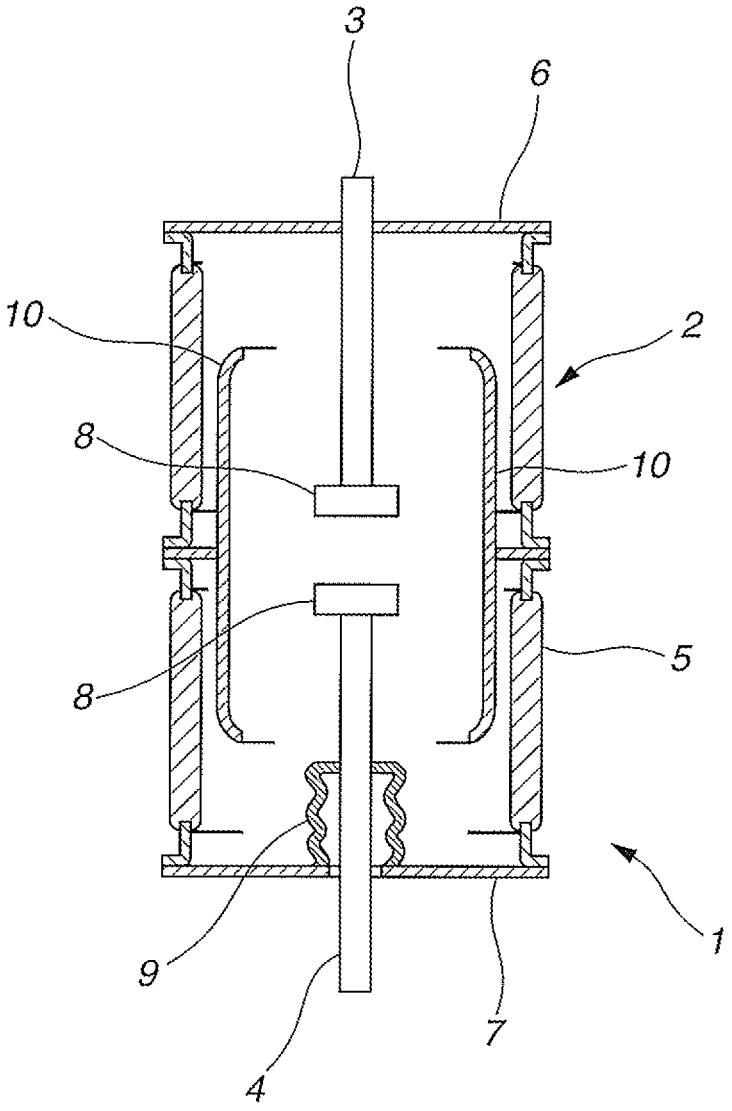
FIG. 3 A schematic cross-sectional view of a vacuum interrupter provided with an electrode material produced by the process for producing an electrode material according to the embodiment of the present invention.

Incidentally, it is possible to construct a vacuum interrupter by using an electrode material produced by a method for producing an electrode material according to an embodiment of the present invention. As shown in FIG. 3, a vacuum interrupter 1 comprising an electrode material according to an embodiment of the present invention is provided to include a vacuum vessel 2, a fixed electrode 3, a movable electrode 4 and a main shield 10.

The vacuum vessel 2 is configured such that an insulating cylinder 5 is sealed at its both opening ends with a fixed-side end plate 6 and a movable-side end plate 7, respectively.

The fixed electrode 3 is fixed in a state of penetrating the fixed-side end plate 6. The fixed electrode 3 is fixed in such a manner that its one end is opposed to one end of the movable electrode 4 in the vacuum vessel 2, and additionally, provided with an electrode contact material 8 (serving as an electrode material according to an embodiment of the present invention) at an end portion opposing to the movable electrode 4.

The movable electrode 4 is provided at the movable-side end plate 7. The movable electrode 4 is disposed coaxial with the fixed electrode 3. The movable electrode 4 is moved in the axial direction by a non-illustrated opening/closing means, with which an opening/closing action between the fixed electrode 3 and the movable electrode 4 is attained. The movable electrode 4 is provided with an electrode contact material 8 at an end portion opposing to the fixed electrode 3. Between the movable electrode 4 and the movable-side end plate 7 a bellows 9 is disposed, so that the movable electrode 4 can vertically be moved to attain the opening/closing action between the fixed electrode 3 and the movable electrode 4 while keeping the vacuum state of the vacuum vessel 2.

The main shield 10 is mounted to cover a contact part of the electrode contact material 8 of the fixed electrode 3 and the electrode contact material 8 of the movable electrode 4, so as to protect the insulating cylinder 5 from an arc generated between the fixed electrode 3 and the movable electrode 4.

EXAMPLE 1

Referring now to a concrete example, a process for producing an electrode material and an electrode material according to an embodiment of the present invention will be discussed in detail. An electrode material of Example 1 is an electrode material produced according to the flow chart as shown in FIG. 1.

A Mo powder and a Cr powder were sufficiently uniformly mixed at a weight ratio of Mo:Cr=9:1 by using a V type blender.

As the Mo powder, a powder having a particle diameter of 0.8 to 6.0 μm was employed. As a result of measuring the particle diameter distribution of this Mo powder by using a laser diffraction particle size analyzer, it was confirmed to have a median diameter d50 of 5.1 μm (and a d10 of 3.1 μm and a d90 of 8.8 μm). The Cr powder was a powder of under-235 mesh (mesh opening of 63 μm).

After the mixing operation was completed, press molding was conducted under a pressing pressure of 4.5 t/cm$^2$ to obtain a molded body having a diameter of 60 mm and a height of 10 mm. This molded body was subjected to heat treatment in a vacuum atmosphere at 1150° C. for 1.5 hours, thereby producing a sintered body. The degree of filling (i.e., the degree of filling before the HIP treatment) that the sintered body had was 65.4%.

A degree of filling "A" (%) was determined by using the following equation:

$$A(\%) = \frac{W}{\pi r^2 t \cdot \{(D_{Mo} \cdot X + D_{Cr} \cdot (1 - X)\}} \times 100$$

where

W: The weight of the press molded body (g), r: The radius of the press molded body (cm), t: The thickness of the press molded body (cm), $D_{Mo}$: The density of the Mo powder (g/cm$^3$), $D_{Cr}$: The density of the Cr powder (g/cm$^3$), and X: The mixing ratio of Mo in the Mo—Cr mixed powder (wherein 0<X<1).

The sintered body was charged into a stainless steel cylindrical vessel (having an inside height of 11 mm, an inside diameter of 62 mm and a wall thickness of 5 mm) and vacuum-sealed therein, followed by being subjected to a HIP treatment within a HIP treatment device at 1050° C. and 70 MPa (0.714 t/cm$^3$) for 2 hours.

To be specific, a carbon sheet (having a diameter of 62 mm and a thickness of 0.4 mm) was laid on the bottom surface of the cylindrical vessel, and then the sintered body was disposed thereon. In addition, a carbon sheet was also provided between the sintered body and the inner wall of the cylindrical vessel. Upon mounting a further carbon sheet on the sintered body, a top lid (having a thickness of 5 mm) was put on the upper opening of the cylindrical vessel. The cylindrical vessel was previously formed to have a step-like portion at its upper inner wall, and the top lid was arranged to be loosely fitted into this step-like portion. By thus interposing the carbon sheet between the sintered body and the inner wall, a melt adhesion between the sintered body and the inner wall due to the HIP treatment can be prevented.

Thereafter, the cylindrical vessel housing the sintered body therein was put into a vacuum equipment and evacuated up to $1.0\times10^{-3}$ Pa. By performing the evacuation step, the interior of the cylindrical vessel (namely, a space in which the sintered body was disposed) was also evacuated up to $1.0\times10^{-3}$ Pa through a gap between the upper opening of the cylindrical vessel and the top lid. Subsequently, the cylindrical vessel was subjected to welding in the vacuum equipment at the gap between the upper opening of the cylindrical vessel and the top lid by electron beam, thereby being vacuum-sealed.

The thus vacuum-sealed cylindrical vessel was subjected to the HIP treatment (1050° C., 70 MPa, 2 hours), and after the HIP treatment a portion welded by electron beam was latched. Since the carbon sheet never adheres to the cylindrical vessel and the sintered body at a heat treatment temperature of 1050° C., it was possible to obtain a HIP-treated body only by removing the carbon sheet having been bonded to the top, bottom and side surfaces of the HIP-treated body. As a result of calculating the degree of filling of the HIP-treated body by measuring the outer diameter and the thickness of the HIP-treated body, it was confirmed that the degree of filling was 74.0%. Upon conducting ultrasonic cleaning with acetone on this HIP-treated body, a Cu plate was placed on the HIP-treated body, followed by carrying out Cu infiltration at 1150° C. for 2 hours in a vacuum atmosphere (or a non-oxidizing atmosphere).

COMPARATIVE EXAMPLE 1

Figure 4:
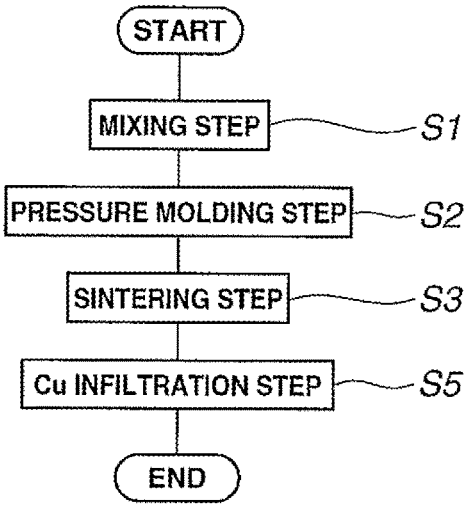
FIG. 4 A flow chart showing a process for producing an electrode material according to Comparative Example.

An electrode material of Comparative Example 1 was an electrode material produced by the same procedure as that of Example 1 with the exception that the HIP treatment was not performed. The electrode material of Comparative Example 1 was an electrode material produced according to the flow chart as shown in FIG. 4. In the flow chart as shown in FIG. 4, steps common with Example 1 are given the same reference numeral; therefore, specific explanations on such steps are omitted.

A Mo powder and a Cr powder were mixed at a weight ratio of Mo:Cr=9:1. After the mixing operation was completed, press molding was conducted under a pressing pressure of 4.5 t/cm$^2$ to obtain a molded body having a diameter of 60 mm and, a height of 10 mm. This molded body was subjected to heat treatment in a vacuum atmosphere at 1150° C. for 1.5 hours, thereby producing a sintered body. The degree of filling of the sintered body was 65.6%. The sintered body was then infiltrated with Cu to serve as the electrode material of Comparative Example 1.

EXAMPLE 2

An electrode material of Example 2 was an electrode material produced by the same procedure as that of Example 1 with the exception that the pressure applied in the press molding step S2 was modified.

As shown in FIG. 1, a Mo powder and a Cr powder were mixed at a weight ratio of Mo:Cr=9:1. After the mixing operation was completed, press molding was conducted under a pressing pressure of 3.8 t/cm$^2$ to obtain a molded body having a diameter of 60 mm and a height of 10 mm. This molded body was subjected to heat treatment in a vacuum atmosphere at 1150° C. for 1.5 hours, thereby producing a sintered body. The degree of filling of the sintered body was 63.8%. On this sintered body, a HIP treatment was performed at 1050° C., 70 MPa for 2 hours. The degree of filling after the HIP treatment was 73.2%. The HIP-treated body was then infiltrated with Cu to serve as the electrode material of Example 2.

EXAMPLE 3

An electrode material of Example 3 was an electrode material produced by the same procedure as that of Example 1 with the exception that the pressure applied in the press molding step S2 was modified.

As shown in FIG. 1, a Mo powder and a Cr powder were mixed at a weight ratio of Mo:Cr=9:1. After the mixing operation was completed, press molding was conducted under a pressing pressure of 3.1 t/cm$^2$ to obtain a molded body having a diameter of 60 mm and a height of 10 mm. This molded body was subjected to heat treatment in a vacuum atmosphere at 1150° C. for 1.5 hours, thereby producing a sintered body. The degree of filling of the sintered body was 60.1%. On this sintered body, a HIP treatment was performed at 1050° C., 70 MPa for 2 hours. The degree of filling after the HIP treatment was 72.7%. The HIP-treated body was then infiltrated with Cu to serve as the electrode material of Example 3.

EXAMPLE 4

An electrode material of Example 4 was an electrode material produced by the same procedure as that of Example 1 with the exception that the pressure applied in the press molding step S2 was modified.

As shown in FIG. 1, a Mo powder and a Cr powder were mixed at a weight ratio of Mo:Cr=9:1. After the mixing operation was completed, press molding was conducted under a pressing pressure of 2.3 t/cm$^2$ to obtain a molded body having a diameter of 60 mm and a height of 10 mm. This molded body was subjected to heat treatment in a vacuum atmosphere at 1150° C. for 1.5 hours, thereby producing a sintered body. The degree of filling of the sintered body was 56.4%. On this sintered body, a HIP treatment was performed at 1050° C., 70 MPa for 2 hours. The degree of filling after the HIP treatment was 72.0%. The HIP-treated body was then infiltrated with Cu to serve as the electrode material of Example 4.

EXAMPLE 5

An electrode material of Example 5 was an electrode material produced by the same procedure as that of Example 1 with the exception that the mixing ratio between Mo and Cr applied in the mixing step S1 was modified.

As shown in FIG. 1, a Mo powder and a Cr powder were mixed at a weight ratio of Mo:Cr=7:1. After the mixing operation was completed, press molding was conducted under a pressing pressure of 4.5 t/cm$^2$ to obtain a molded body having a diameter of 60 mm and a height of 10 mm. This molded body was subjected to heat treatment in a vacuum atmosphere at 1150° C. for 1.5 hours, thereby producing a sintered body. The degree of filling of the sintered body was 66.4%. On this sintered body, a HIP treatment was performed at 1050° C., 70 MPa for 2 hours. The degree of filling after the HIP treatment was 75.3%. The HIP-treated body was then infiltrated with Cu to serve as the electrode material of Example 5.

EXAMPLE 6

An electrode material of Example 6 was an electrode material produced by the same procedure as that of Example 1 with the exception that the mixing ratio between Mo and Cr applied in the mixing step S1 was modified.

As shown in FIG. 1, a Mo powder and a Cr powder were mixed at a weight ratio of Mo:Cr=4:1. After the mixing operation was completed, press molding was conducted under a pressing pressure of 4.5 t/cm$^2$ to obtain a molded body having a diameter of 60 mm and a height of 10 mm. This molded body was subjected to heat treatment in a vacuum atmosphere at 1150° C. for 1.5 hours, thereby producing a sintered body. The degree of filling of the sintered body was 68.7%. On this sintered body, a HIP treatment was performed at 1050° C., 70 MPa for 2 hours. The degree of filling after the HIP treatment was 79.2%. The HIP-treated body was then infiltrated with Cu to serve as the electrode material of Example 6.

EXAMPLE 7

An electrode material of Example 7 was an electrode material produced by the same procedure as that of Example 1 with the exception that the particle diameter of Cr to be mixed with Mo in the mixing step S1 was modified. More specifically, the electrode material of Example 7 was an electrode material produced by using a Cr powder of under-180 mesh (a particle diameter of less than 80 μm).

As shown in FIG. 1, a Mo powder and a Cr powder were mixed at a weight ratio of Mo:Cr=4:1. After the mixing operation was completed, press molding was conducted under a pressing pressure of 4.5 t/cm$^2$ to obtain a molded body having a diameter of 60 mm and a height of 10 mm. This molded body was subjected to heat treatment in a vacuum atmosphere at 1150° C. for 1.5 hours, thereby producing a sintered body. The degree of filling of the sintered body was 69.0%. On this sintered body, a HIP treatment was performed at 1050° C., 70 MPa for 2 hours. The degree of filling after the HIP treatment was 76.9%. The HIP-treated body was then infiltrated with Cu to serve as the electrode material of Example 7.

EXAMPLE 8

An electrode material of Example 8 was an electrode material produced by the same procedure as that of Example 7 with the exception that the pressure applied in the press molding step S2 was modified.

As shown in FIG. 1, a Mo powder and a Cr powder were mixed at a weight ratio of Mo:Cr=4:1. After the mixing operation was completed, press molding was conducted under a pressing pressure of 3.8 t/cm$^2$ to obtain a molded body having a diameter of 60 mm and a height of 10 mm. This molded body was subjected to heat treatment in a vacuum atmosphere at 1150° C. for 1.5 hours, thereby producing a sintered body. The degree of filling of the sintered body was 63.1%. On this sintered body, a HIP treatment was performed at 1050° C., 70 MPa for 2 hours. The degree of filling after the HIP treatment was 73.9%. The HIP-treated body was then infiltrated with Cu to serve as the electrode material of Example 8.

EXAMPLE 9

An electrode material of Example 9 was an electrode material produced by the same procedure as that of Example 7 with the exception that the mixing ratio between Mo and Cr applied in the mixing step S1 was modified.

As shown in FIG. 1, a Mo powder and a Cr powder were mixed at a weight ratio of Mo:Cr=7:1. After the mixing operation was completed, press molding was conducted under a pressing pressure of 4.5 t/cm$^2$ to obtain a molded body having a diameter of 60 mm and a height of 10 mm. This molded body was subjected to heat treatment in a vacuum atmosphere at 1150° C. for 1.5 hours, thereby producing a sintered body. The degree of filling of the sintered body was 68.0%. On this sintered body, a HIP treatment was performed at 1050° C., 70 MPa for 2 hours. The degree of filling after the HIP treatment was 74.6%. The HIP-treated body was then infiltrated with Cu to serve as the electrode material of Example 9.

EXAMPLE 10

An electrode material of Example 9 was an electrode material produced by the same procedure as that of Example 10 with the exception that the pressure applied in the press molding step S2 was modified.

As shown in FIG. 1, a Mo powder and a Cr powder were mixed at a weight ratio of Mo:Cr=7:1. After the mixing operation was completed, press molding was conducted under a pressing pressure of 3.8 t/cm$^2$ to obtain a molded body having a diameter of 60 mm and a height of 10 mm. This molded body was subjected to heat treatment in a vacuum atmosphere at 1150° C. for 1.5 hours, thereby producing a sintered body. The degree of filling of the sintered body was 63.0%. On this sintered body, a HIP treatment was performed at 1050° C., 70 MPa for 2 hours. The degree of filling after the HIP treatment was 72.7%. The HIP-treated body was then infiltrated with Cu to serve as the electrode material of Example 10.

EXAMPLE 11

An electrode material of Example 11 was an electrode material produced by the same procedure as that of Example 7 with the exception that the mixing ratio between Mo and Cr applied in the mixing step S1 was modified.

As shown in FIG. 1, a Mo powder and a Cr powder were mixed at a weight ratio of Mo:Cr=9:1. After the mixing operation was completed, press molding was conducted under a pressing pressure of 4.5 t/cm$^2$ to obtain a molded body having a diameter of 60 mm and a height of 10 mm. This molded body was subjected to heat treatment in a vacuum atmosphere at 1150° C. for 1.5 hours, thereby producing a sintered body. The degree of filling of the sintered body was 67.6%. On this sintered body, a HIP treatment was performed at 1050° C., 70 MPa for 2 hours. The degree of filling after the HIP treatment was 73.8%. The HIP-treated body was then infiltrated with Cu to serve as the electrode material of Example 11.

EXAMPLE 12

An electrode material of Example 12 was an electrode material produced by the same procedure as that of Example 11 with the exception that the pressure applied in the press molding step S2 was modified.

As shown in FIG. 1, a Mo powder and a Cr powder were mixed at a weight ratio of Mo:Cr=9:1. After the mixing operation was completed, press molding was conducted under a pressing pressure of 3.8 t/cm$^2$ to obtain a molded body having a diameter of 60 mm and a height of 10 mm. This molded body was subjected to heat treatment in a vacuum atmosphere at 1150° C. for 1.5 hours, thereby producing a sintered body. The degree of filling of the sintered body was 62.2%. On this sintered body, a HIP treatment was performed at 1050° C., 70 MPa for 2 hours. The degree of filling after the HIP treatment was 72.2%. The HIP-treated body was then infiltrated with Cu to serve as the electrode material of Example 12.

EXAMPLE 13

An electrode material of Example 13 was an electrode material produced by the same procedure as that of Example 7 with the exception that the mixing ratio between Mo and Cr applied in the mixing step S1 was modified.

As shown in FIG. 1, a Mo powder and a Cr powder were mixed at a weight ratio of Mo:Cr=3:1. After the mixing operation was completed, press molding was conducted under a pressing pressure of 4.5 t/cm$^2$ to obtain a molded body having a diameter of 60 mm and a height of 10 mm. This molded body was subjected to heat treatment in a vacuum atmosphere at 1150° C. for 1.5 hours, thereby producing a sintered body. The degree of filling of the sintered body was 69.3%. On this sintered body, a HIP treatment was performed at 1050° C., 70 MPa for 2 hours. The degree of filling after the HIP treatment was 78.1%. The HIP-treated body was then infiltrated with Cu to serve as the electrode material of Example 13.

EXAMPLE 14

An electrode material of Example 14 was an electrode material produced by the same procedure as that of Example 6 with the exception that the particle diameter of Cr to be mixed with Mo in the mixing step S1 was modified. More specifically, the electrode material of Example 14 was an electrode material produced by using a Cr powder of under-330 mesh (a particle diameter of less than 45 μm).

As shown in FIG. 1, a Mo powder and a Cr powder were mixed at a weight ratio of Mo:Cr=4:1. After the mixing operation was completed, press molding was conducted under a pressing pressure of 4.5 t/cm$^2$ to obtain a molded body having a diameter of 60 mm and a height of 10 mm. This molded body was subjected to heat treatment in a vacuum atmosphere at 1150° C. for 1.5 hours, thereby producing a sintered body. The degree of filling of the sintered body was 68.3%. On this sintered body, a HIP treatment was performed at 1050° C., 70 MPa for 2 hours. The degree of filling after the HIP treatment was 78.5%. The HIP-treated body was then infiltrated with Cu to serve as the electrode material of Example 14.

EXAMPLE 15

An electrode material of Example 15 was an electrode material produced by the same procedure as that of Example 14 with the exception that the mixing ratio between Mo and Cr applied in the mixing step S1 was modified.

As shown in FIG. 1, a Mo powder and a Cr powder were mixed at a weight ratio of Mo:Cr=7:1. After the mixing operation was completed, press molding was conducted under a pressing pressure of 4.5 t/cm$^2$ to obtain a molded body having a diameter of 60 mm and a height of 10 mm. This molded body was subjected to heat treatment in a vacuum atmosphere at 1150° C. for 1.5 hours, thereby producing a sintered body. The degree of filling of the sintered body was 66.0%. On this sintered body, a HIP treatment was performed at 1050° C., 70 MPa for 2 hours. The degree of filling after the HIP treatment was 75.3%. The HIP-treated body was then infiltrated with Cu to serve as the electrode material of Example 15.

EXAMPLE 16

An electrode material of Example 16 was an electrode material produced by the same procedure as that of Example 14 with the exception that the mixing ratio between Mo and Cr applied in the mixing step S1 was modified.

As shown in FIG. 1, a Mo powder and a Cr powder were mixed at a weight ratio of Mo:Cr=9:1. After the mixing operation was completed, press molding was conducted under a pressing pressure of 4.5 t/cm$^2$ to obtain a molded body having a diameter of 60 mm and a height of 10 mm. This molded body was subjected to heat treatment in a vacuum atmosphere at 1150° C. for 1.5 hours, thereby producing a sintered body. The degree of filling of the sintered body was 64.6%. On this sintered body, a HIP treatment was performed at 1050° C., 70 MPa for 2 hours. The degree of filling after the HIP treatment was 74.6%. The HIP-treated body was then infiltrated with Cu to serve as the electrode material of Example 16.

COMPARATIVE EXAMPLES 2 to 16

As Comparative Examples 2 to 16 corresponding to Examples 2 to 16, electrode materials were produced by the same procedures as those of Examples 2 to 16, respectively, with the exception that the HIP treatment was not performed.

The results of measuring the electrode materials of Examples 1 to 16 and Comparative Examples 1 to 16 in terms of conductivity (% IACS), micro-Vickers hardness and impulse withstand voltage are shown in Table 1. Table 1 also indicates the results of measuring Examples 1 to 16 in terms of degree of filling that the sintered body had before and after the HIP treatment and the results of measuring Comparative Examples 1 to 16 in terms of degree of filling after the sintering step.

The measurement of impulse withstand voltage was carried out upon processing each of the electrode materials into a disc electrode having a diameter of 25 mm as an electrode material for use in a vacuum interrupter (the same goes for the other Examples and Comparative Examples). In table 1, the withstand voltage is expressed by a value relative to an electrode material produced under the same conditions with the exception of the presence or absence of the HIP treatment; namely, the withstand voltage is expressed by a relative value based on an electrode material on which the HIP treatment was not conducted (wherein the standard value is one).

TABLE 1

| | Mo particle diameter (μm) | Cr particle diameter (μm) | Mixing Ratio Mo:Cr | Pressure applied in press molding Mo—Cr mixed powder (t/cm$^2$) | Degree of filling after sintering (%) | Presence or absence of HIP treatment | Degree of filling after HIP treatment (%) | Conductivity (% IACS) | Vickers hardness after Cu infiltration (Hv) | Relative withstand voltage |
|---|---|---|---|---|---|---|---|---|---|---|
| Example 1 | 0.8-6.0 | 63 | 9:1 | 4.5 | 65.4 | Done | 74.0 | 27.3 | 321 | 1.02 |
| Comparative Example 1 | 0.8-6.0 | 63 | 9:1 | 4.5 | 65.6 | Not done | | 28.5 | 274 | 1 |
| Example 2 | 0.8-6.0 | 63 | 9:1 | 3.8 | 63.8 | Done | 73.2 | 27.5 | 312 | 1.05 |
| Comparative Example 2 | 0.8-6.0 | 63 | 9:1 | 3.8 | 63.4 | Not done | | 30.1 | 238 | 1 |
| Example 3 | 0.8-6.0 | 63 | 9:1 | 3.1 | 60.1 | Done | 72.7 | 28.0 | 310 | 1.12 |
| Comparative Example 3 | 0.8-6.0 | 63 | 9:1 | 3.1 | 60.3 | Not done | | 32.9 | 227 | 1 |
| Example 4 | 0.8-6.0 | 63 | 9:1 | 2.3 | 56.4 | Done | 72.0 | 28.5 | 306 | 1.15 |
| Comparative Example 4 | 0.8-6.0 | 63 | 9:1 | 2.3 | 56.3 | Not done | | 34.7 | 193 | 1 |
| Example 5 | 0.8-6.0 | 63 | 7:1 | 4.5 | 66.4 | Done | 75.3 | 26.2 | 361 | 1.06 |
| Comparative Example 5 | 0.8-6.0 | 63 | 7:1 | 4.5 | 66.5 | Not done | | 28.3 | 296 | 1 |
| Example 6 | 0.8-6.0 | 63 | 4:1 | 4.5 | 68.7 | Done | 79.2 | 22.8 | 370 | 1.05 |
| Comparative Example 6 | 0.8-6.0 | 63 | 4:1 | 4.5 | 68.9 | Not done | | 28.7 | 326 | 1 |
| Example 7 | 0.8-6.0 | 80 | 4:1 | 4.5 | 69.0 | Done | 76.9 | 23.0 | 438 | 1.05 |
| Comparative Example 7 | 0.8-6.0 | 80 | 4:1 | 4.5 | 68.9 | Not done | | 28.8 | 401 | 1 |
| Example 8 | 0.8-6.0 | 80 | 4:1 | 3.8 | 63.1 | Done | 73.9 | 23.8 | 440 | 1.15 |
| Comparative Example 8 | 0.8-6.0 | 80 | 4:1 | 3.8 | 63.4 | Not done | | 26.7 | 307 | 1 |
| Example 9 | 0.8-6.0 | 80 | 7:1 | 4.5 | 68.0 | Done | 74.6 | 24.8 | 359 | 1.10 |
| Comparative Example 9 | 0.8-6.0 | 80 | 7:1 | 4.5 | 68.5 | Not done | | 28.0 | 315 | 1 |

TABLE 1-continued

| | Mo particle diameter (μm) | Cr particle diameter (μm) | Mixing Ratio Mo:Cr | Pressure applied in press molding Mo—Cr mixed powder (t/cm$^2$) | Degree of filling after sintering (%) | Presence or absence of HIP treatment | Degree of filling after HIP treatment (%) | Conductivity (% IACS) | Vickers hardness after Cu infiltration (Hv) | Relative withstand voltage |
|---|---|---|---|---|---|---|---|---|---|---|
| Example 10 | 0.8-6.0 | 80 | 7:1 | 3.8 | 63.0 | Done | 72.7 | 26.4 | 335 | 1.10 |
| Comparative Example 10 | 0.8-6.0 | 80 | 7:1 | 3.8 | 62.7 | Not done | | 29.8 | 255 | 1 |
| Example 11 | 0.8-6.0 | 80 | 9:1 | 4.5 | 67.6 | Done | 73.8 | 25.8 | 337 | 1.10 |
| Comparative Example 11 | 0.8-6.0 | 80 | 9:1 | 4.5 | 67.7 | Not done | | 28.7 | 290 | 1 |
| Example 12 | 0.8-6.0 | 80 | 9:1 | 3.8 | 62.2 | Done | 72.2 | 26.9 | 316 | 1.11 |
| Comparative Example 12 | 0.8-6.0 | 80 | 9:1 | 3.8 | 63.0 | Not done | | 30.0 | 243 | 1 |
| Example 13 | 0.8-6.0 | 80 | 3:1 | 4.5 | 69.3 | Done | 78.1 | 20.6 | 463 | 1.10 |
| Comparative Example 13 | 0.8-6.0 | 80 | 3:1 | 4.5 | 69.1 | Not done | | 20.6 | 363 | 1 |
| Example 14 | 0.8-6.0 | 45 | 4:1 | 4.5 | 68.3 | Done | 78.5 | 22.2 | 461 | 1.10 |
| Comparative Example 14 | 0.8-6.0 | 45 | 4:1 | 4.5 | 68.5 | Not done | | 23.9 | 380 | 1 |
| Example 15 | 0.8-6.0 | 45 | 7:1 | 4.5 | 66.0 | Done | 75.3 | 24.7 | 378 | 1.10 |
| Comparative Example 15 | 0.8-6.0 | 45 | 7:1 | 4.5 | 65.7 | Not done | | 25.2 | 293 | 1 |
| Example 16 | 0.8-6.0 | 45 | 9:1 | 4.5 | 64.6 | Done | 74.6 | 25.2 | 327 | 1.05 |
| Comparative Example 16 | 0.8-6.0 | 45 | 9:1 | 4.5 | 64.3 | Not done | | 26.8 | 273 | 1 |

As shown in Table 1, it was confirmed that when performing the HIP treatment the micro-Vickers hardness was improved after the Cu infiltration without a significant reduction of the conductivity (% IACS) while enhancing the withstand voltage by 2 to 15% as compared with that of an electrode material on which the HIP treatment was not conducted.

Additionally, from the results of measuring Examples 1 to 16 in terms of degree of filling before and after the HIP treatment and from the results of measuring Comparative Examples 1 to 16 in terms of degree of filling after the sintering step, it is confirmed that the sintered body attains a degree of filling the heat resistant element powder of 75% or greater (i.e., a porosity of 25% or less) by performing the HIP treatment, which is so high as not to have been accomplished in the production technique consisting of a conventional series of steps of press molding, sintering and Cu infiltration.

Moreover, the electrode materials of Examples 1 to 16 are considered to have been accelerated in degasification of the sintered body was accelerated by being subjected to the HIP treatment step S4 after the sintering step S3. As a consequence, in the cylindrical vessel used in the HIP treatment step S4, the amount of gas discharged from the interior of the sintered body is reduced so that the surface of the sintered body is prevented from oxidation which can be caused by the discharged gas, which results in an enhancement of the withstand voltage capability of the electrode material.

EXAMPLE 17

An electrode material of Example 17 was an electrode material produced by the same procedure as that of Example 5 with the exception that the sintering step was not performed.

As shown in FIG. 2, a Mo powder and a Cr powder were mixed at a weight ratio of Mo:Cr=7:1. After the mixing operation was completed, press molding was conducted under a pressing pressure of 4.5 t/cm$^2$ to obtain a molded body having a diameter of 60 mm and a height of 10 mm. On this molded body, a HIP treatment was performed at 1050° C., 70 MPa for 2 hours. The degree of filling after the HIP treatment was 74.1%. The HIP-treated body was then infiltrated with Cu to serve as the electrode material of Example 17.

The results of measuring the electrode material of Example 17 in terms of conductivity (% IACS), micro-Vickers hardness and impulse withstand voltage are shown in Table 2.

TABLE 2

| | Mo particle diameter (μm) | Cr particle diameter (μm) | Mixing Ratio Mo:Cr | Pressure applied in press molding Mo—Cr mixed powder (t/cm$^2$) | Degree of filling after sintering (%) | Presence or absence of HIP treatment | Degree of filling after HIP treatment (%) | Conductivity (% IACS) | Vickers hardness after Cu infiltration (Hv) | Relative withstand voltage |
|---|---|---|---|---|---|---|---|---|---|---|
| Example 17 | 0.8-6.0 | 63 | 7:1 | 4.5 | — | Done | 74.1 | 26.2 | 351 | 1.04 |
| Comparative Example 5 | 0.8-6.0 | 63 | 7:1 | 4.5 | 66.5 | Not done | | 28.3 | 296 | 1 |

As shown in Table 2, the withstand voltage capability was confirmed to be improved also in the case of not performing the sintering step S3, as compared with Comparative Example (Comparative Example 5) where the HIP treatment was not operated.

Since Example 17 had no sintering step S3, the amount of gas discharged from the interior of the cylindrical vessel used in the HIP treatment is considered larger than that in Example 5. In other words, this electrode material is considered to be reduced in withstand voltage capability because an oxide is generated on the surface of the sintered body due to the gas discharged from the interior of the surface of the sintered body. Nevertheless, there is no remarkable difference between the withstand voltage capability of the electrode material of Example 5 and that of Example 17, which is considered because a removal of the oxide is performed by Cu getting melt at the time of the Cu infiltration to cover the periphery of the Mo—Cr particles.

EXAMPLE 18

An electrode material of Example 18 was an electrode material produced by the same procedure as that of Example 1 with the exception that the particle diameter of Mo to be mixed with Cr in the mixing step S1 was modified. More specifically, the electrode material of Example 18 was an electrode material produced by using a Mo powder having a particle diameter of 5.2 to 18.6 μm and a median diameter d50 of 11.5 μm (and a d10 of 5.2 μm and a d90 of 19.6 μm).

As shown in FIG. 1, a Mo powder and a Cr powder were mixed at a weight ratio of Mo:Cr=9:1. After the mixing operation was completed, press molding was conducted under a pressing pressure of 4.5 t/cm$^2$ to obtain a molded body having a diameter of 60 mm and a height of 10 mm. This molded body was subjected to heat treatment in a vacuum atmosphere at 1150° C. for 1.5 hours, thereby producing a sintered body. The degree of filling of the sintered body was 67.1%. On this sintered body, a HIP treatment was performed at 1050° C., 70 MPa for 2 hours. The degree of filling after the HIP treatment was 75.0%. The HIP-treated body was then infiltrated with Cu to serve as the electrode material of Example 18.

EXAMPLE 19

An electrode material of Example 19 was an electrode material produced by the same procedure as that of Example 18 with the exception that the mixing ratio between Mo and Cr applied in the mixing step S1 was modified.

As shown in FIG. 1, a Mo powder and a Cr powder were mixed at a weight ratio of Mo:Cr=4:1. After the mixing operation was completed, press molding was conducted under a pressing pressure of 4.5 t/cm$^2$ to obtain a molded body having a diameter of 60 mm and a height of 10 mm. This molded body was subjected to heat treatment in a vacuum atmosphere at 1150° C. for 1.5 hours, thereby producing a sintered body. The degree of filling of the sintered body was 70.3%. On this sintered body, a HIP treatment was performed at 1050° C., 70 MPa for 2 hours. The degree of filling after the HIP treatment was 80.2%. The HIP-treated body was then infiltrated with Cu to serve as the electrode material of Example 19.

EXAMPLE 20

An electrode material of Example 20 was an electrode material produced by the same procedure as that of Example 18 with the exception that the particle diameter of Cr to be mixed with Mo in the mixing step S1 was modified. More specifically, the electrode material of Example 20 was an electrode material produced by using a Cr powder of under-180 mesh (a particle diameter of less than 80 μm).

As shown in FIG. 1, a Mo powder and a Cr powder were mixed at a weight ratio of Mo:Cr=9:1. After the mixing operation was completed, press molding was conducted under a pressing pressure of 4.5 t/cm$^2$ to obtain a molded body having a diameter of 60 mm and a height of 10 mm. This molded body was subjected to heat treatment in a vacuum atmosphere at 1150° C. for 1.5 hours, thereby producing a sintered body. The degree of filling of the sintered body was 69.1%. On this sintered body, a HIP treatment was performed at 1050° C., 70 MPa for 2 hours. The degree of filling after the HIP treatment was 75.0%. The HIP-treated body was then infiltrated with Cu to serve as the electrode material of Example 20.

EXAMPLE 2

An electrode material of Example 21 was an electrode material produced by the same procedure as that of Example 20 with the exception that the mixing ratio between Mo and Cr applied in the mixing step S1 was modified.

As shown in FIG. 1, a Mo powder and a Cr powder were mixed at a weight ratio of Mo:Cr=3:1. After the mixing operation was completed, press molding was conducted under a pressing pressure of 4.5 t/cm$^2$ to obtain a molded body having a diameter of 60 mm and a height of 10 mm. This molded body was subjected to heat treatment in a vacuum atmosphere at 1150° C. for 1.5 hours, thereby producing a sintered body. The degree of filling of the sintered body was 71.0%. On this sintered body, a HIP treatment was performed at 1050° C., 70 MPa for 2 hours. The degree of filling after the HIP treatment was 79.1%. The HIP-treated body was then infiltrated with Cu to serve as the electrode material of Example 21.

EXAMPLE 22

An electrode material of Example 22 was an electrode material produced by the same procedure as that of Example 18 with the exception that the particle diameter of Cr to be mixed with Mo in the mixing step S1 was modified. More specifically, the electrode material of Example 22 was an electrode material produced by using a Cr powder of under-330 mesh (a particle diameter of less than 45 μm).

As shown in FIG. 1, a Mo powder and a Cr powder were mixed at a weight ratio of Ma:Cr=9:1. After the mixing operation was completed, press molding was conducted under a pressing pressure of 4.5 t/cm$^2$ to obtain a molded body having a diameter of 60 mm and a height of 10 mm. This molded body was subjected to heat treatment in a vacuum atmosphere at 1150° C. for 1.5 hours, thereby producing a sintered body. The degree of filling of the sintered body was 66.3%. On this sintered body; a HIP treatment was performed at 1050° C., 70 MPa for 2 hours. The degree of filling after the HIP treatment was 75.9%. The HIP-treated body was then infiltrated with Cu to serve as the electrode material of Example 22.

EXAMPLE 23

An electrode material of Example 23 was an electrode material produced by the same procedure as that of Example 22 with the exception that the mixing ratio between Mo and Cr applied in the mixing step S1 was modified.

As shown in FIG. 1, a Mo powder and a Cr powder were mixed at a weight ratio of Mo:Cr=4:1. After the mixing operation was completed, press molding was conducted under a pressing pressure of 4.5 t/cm$^2$ to obtain a molded body having a diameter of 60 mm and a height of 10 mm. This molded body was subjected to heat treatment in a vacuum atmosphere at 1150° C. for 1.5 hours, thereby producing a sintered body. The degree of filling of the sintered body was 70.0%. On this sintered body, a HIP treatment was performed at 1050° C., 70 MPa for 2 hours. The degree of filling after the HIP treatment was 79.6%. The HIP-treated body was then infiltrated with Cu to serve as the electrode material of Example 23.

COMPARATIVE EXAMPLES 18 to 23

As Comparative Examples 18 to 23 corresponding to Examples 18 to 23, electrode materials were produced by the same procedures as those of Examples 18 to 23, respectively, with the exception that the HIP treatment was not performed.

The results of measuring the electrode materials of Examples 18 to 23 and Comparative Examples 18 to 23 in terms of conductivity (% IACS), micro-Vickers hardness and impulse withstand voltage are shown in Table 3. Table 3 also indicates the results of measuring Examples 18 to 23 in terms of degree of filling that the sintered body had before and after the HIP treatment and the results of measuring Comparative Examples 18 to 23 in terms of degree of filling after the sintering step.

containing a heat resistant element and Cr is infiltrated with a highly conductive metal to obtain an electrode material, it is possible to improve the sintered body in degree of filling by carrying out the HIP treatment before the infiltration. As a result, the withstand voltage capability of the electrode material is enhanced. Furthermore, since the hardness of the electrode material after the infiltration is also improved, the withstand voltage capability of the electrode material is further enhanced.

In a powder metallurgy technique, the HIP treatment technique has hitherto been used mainly for the purpose of removing internal pores. For example, the HIP treatment technique is employed also in the process for producing an electrode material for use in a vacuum interrupter (Patent Document 4, for example). However, the HIP treatment technique of Patent Document 4 is one that performs a liquid phase sintering at temperatures not lower than the melting point of Cu (as a conductive metal) and not higher than the melting point of Cr so as to melt the conductive metal, thereby producing a high density sintered body. Namely, the HIP treatment is carried out for the purpose of bring the relative density of the target material closer to 100%.

TABLE 3

| | Mo particle diameter (μm) | Cr particle diameter (μm) | Mixing Ratio Mo:Cr | Pressure applied in press molding Mo—Cr mixed powder (t/cm$^2$) | Degree of filling after sintering (%) | Presence or absence of HIP treatment | Degree of filling after HIP treatment (%) | Conductivity (% IACS) | Vickers hardness after Cu infiltration (Hv) | Relative withstand voltage |
|---|---|---|---|---|---|---|---|---|---|---|
| Example 18 | 5.2-18.6 | 63 | 9:1 | 4.5 | 67.1 | Done | 75.0 | 28.2 | 325 | 1.04 |
| Comparative Example 18 | 5.2-18.6 | 63 | 9:1 | 4.5 | 67.0 | Not done | | 29.5 | 286 | 1 |
| Example 19 | 5.2-18.6 | 63 | 4:1 | 4.5 | 70.3 | Done | 80.2 | 23.7 | 388 | 1.05 |
| Comparative Example 19 | 5.2-18.6 | 63 | 4:1 | 4.5 | 70.3 | Not done | | 29.0 | 341 | 1 |
| Example 20 | 5.2-18.6 | 80 | 9:1 | 4.5 | 69.1 | Done | 75.0 | 28.4 | 350 | 1.08 |
| Comparative Example 20 | 5.2-18.6 | 80 | 9:1 | 4.5 | 69.2 | Not done | | 29.9 | 301 | 1 |
| Example 21 | 5.2-18.6 | 80 | 3:1 | 4.5 | 71.0 | Done | 79.1 | 19.2 | 482 | 1.10 |
| Comparative Example 21 | 5.2-18.6 | 80 | 3:1 | 4.5 | 71.1 | Not done | | 20.6 | 371 | 1 |
| Example 22 | 5.2-18.6 | 45 | 9:1 | 4.5 | 66.3 | Done | 75.9 | 25.5 | 341 | 1.08 |
| Comparative Example 22 | 5.2-18.6 | 45 | 9:1 | 4.5 | 66.4 | Not done | | 27.0 | 294 | 1 |
| Example 23 | 5.2-18.6 | 45 | 4:1 | 4.5 | 70.0 | Done | 79.6 | 22.9 | 479 | 1.09 |
| Comparative Example 23 | 5.2-18.6 | 45 | 4:1 | 4.5 | 70.2 | Not done | | 24.1 | 382 | 1 |

As shown in Table 3, it was confirmed that when performing the HIP treatment the micro-Vickers hardness was improved without a significant reduction of the conductivity (% IACS) after the Cu infiltration while enhancing the withstand voltage capability as compared with that of an electrode material on which the HIP treatment was not conducted.

Additionally, a sintered body attaining a degree of filling the heat resistant element powder of 75% or greater (i.e., a porosity of 25% or less) was obtained by performing the HIP treatment, which degree of filling is so high as not to have been accomplished in the production technique consisting of a conventional series of steps of press molding, sintering and Cu infiltration.

According to the above-mentioned process for producing an electrode material relating to an embodiment of the present invention wherein a sintered body (or a porous body)

On the contrary, the purpose of the present invention is not for obtaining a high density sintered body the degree of filling of which is close to 100% but for controlling a heat resistant material having high melting point in terms of degree of filling (i.e. porosity). More specifically, when the degree of filling is adjusted to 65 to 95%, preferably 70 to 92.5%, much more preferably 75 to 90%, it becomes possible to acquire an electrode material excellent in withstand voltage capability without a reduction of the contact resistance characteristics of an electrode.

In addition, it is difficult in die molding, CIP, casting, injection molding and extrusion to increase the powder-filling density up to 75% or more as shown in Table 4. For example, even in the CIP method which can provide a high powder-filling density, the powder-filling density ranges between 60 and 75% (Non-Patent Document 2, for example)

TABLE 4

| | ρ/ρt × 100 |
|---|---|
| Die molding | 50-65% |
| CIP | 60-75% |
| Casting | 55-70% |
| Injection molding | 55-65% |
| Extrusion | 55-65% |

As mentioned above, according to the process for producing an electrode material and an electrode material relating to an embodiment of the present invention, it becomes possible to obtain an electrode material having a large content of a heat resistant element in the Cu base material by improving the electrode material in degree of filling. In other words, when performing the HIP treatment in an atmosphere of high temperature and high pressure, a synergistic effect between the temperature and the pressure is produced thereby making it possible to enhance a Mo—Cr molded body in degree of filling.

Figure 5:
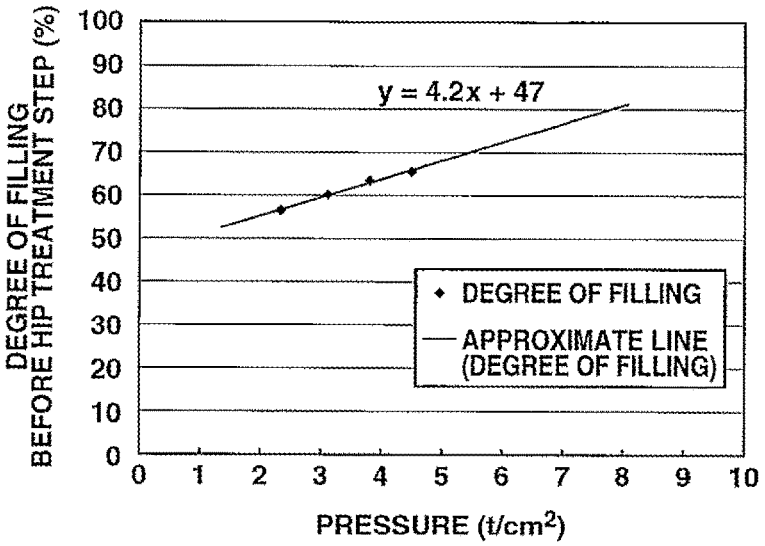
FIG. 5 A characteristic diagram showing a relationship between a pressing pressure and a degree of filling.

As shown in FIG. 5, when the molding pressure in press molding is increased, the degree of filling that the electrode material has tends to increase together therewith. Consequently, the conventional electrode material production methods may also be able to improve the electrode material in degree of filling a heat resistant element by increasing the pressing pressure at the time of molding.

An approximate curve of a plot of the results of measuring the degree of filling y (%) obtained from each molding pressure x (t/cm$^2$) of Examples 1 to 4 and Comparative Examples 1 to 4, as shown in FIG. 5, is expressed by the following equation [1].

$$y=4.2x+47 \quad [1]$$

From this equation, it is apparent that a molding pressure of 5.9 t/cm$^2$ is necessary in order to acquire a degree of filling of 72% without performing the HIP treatment. Namely, in order to obtain an electrode having a diameter of 100 mm, a large press machine which can perform pressing of 500 t or greater is needed. However, the introduction of the large press machine increases the cost and therefore extremely uneconomical. Moreover, a higher pressing pressure makes a mold more worn out so as to shorten the life of the mold.

In the case of producing a molded body of 25 mm diameter by pressing it under a pressing pressure of 0.2 to 4.5 t/cm$^2$, the required pressing pressure is 1.0 to 22.1 t, and therefore such a pressing can be achieved in use of a press machine giving a 25 t pressing performance. However, in the case of producing a molded body of 100 mm diameter by pressing it under a pressing pressure of 0.2 to 4.5 t/cm$^2$, a press machine which can perform pressing of 15.7 to 353 t is needed. Namely, in order to obtain a molded body having a large diameter (for example, a diameter of not smaller than 100 mm), it is necessary to prepare a large press machine giving about 400 t pressing performance.

On the contrary, the process for producing an electrode material according to the present invention carries out the HIP treatment step before infiltrating a highly conductive metal, so that it becomes possible to improve the sintered body (or the molded body) in degree of filling. As a result, the molding pressure applied at the molding step can be reduced. In Example 4, for example, heat treatment was conducted in a vacuum atmosphere at 1150° C. for 1.5 hours after a press molding of 2.3 t/cm$^2$ thereby obtaining a sintered body having a degree of filling of 56.4%, and thereafter, a HIP treatment was performed thereon thereby improving the degree of filling up to 72.0%. Accordingly, in the case of producing an electrode of 100 mm diameter, a press machine is required only to have a pressing performance of at least 200 t, so that the production of an electrode material becomes feasible without the introduction of a large press machine.

In addition, according to the process for producing an electrode material and an electrode material relating to an embodiment of the present invention, a carbon sheet (a member which can adhere to neither the sintered body nor the cylindrical vessel) is inserted between the sintered body and the cylindrical vessel at the time of the HIP treatment step. With this, a HIP-treated body can easily be obtained only by removing the carbon sheet.

Furthermore, by sintering a heat resistant element-containing mixed powder after press molding it and then subjecting the sintered body to the HIP treatment, the amount of gas having remained in the sintered body to be subjected to the HIP treatment is so reduced as to be able to prevent the surface of the sintered body from oxidation during the HIP treatment. As a consequence, an electrode material with good withstand voltage capability can be produced.

If an electrode material according to an embodiment of the present invention is disposed at least at one of a fixed electrode and a movable electrode of a vacuum interrupter (VI), the withstand voltage capability of an electrode contact of the vacuum interrupter is to be improved. When the withstand voltage capability of the electrode contact is improved, a gap defined between the fixed electrode and the movable electrode can be shortened as compared with that of conventional vacuum interrupters and additionally a gap defined between the fixed electrode or the movable electrode and a main shield can also be shortened; therefore, it is possible to minify the structure of the vacuum interrupter. As a result, the vacuum interrupter may be reduced in size. Since the size of the vacuum interrupter can thus be reduced, it is possible to reduce the manufacturing cost of the vacuum interrupter.

Although an embodiment of the present invention has been described above by reference only to some specified preferable examples, the present invention is not limited to those. Various modifications and variations in the scope of the technical idea of the present invention will occur to those skilled in the art, and such variations and modifications are within the scope of the claims as a matter of course.

For example, the press molding step is not limited to a press molding which uses a press machine, which is feasible even by other molding methods such as cold isostatic pressing (CIP), casting, injection molding and extrusion.

Moreover, a solid solution of a heat resistant element and Cr may previously formed, and the sintered body (or the porous body) may be obtained by using a powder of this heat resistant element-Cr solid solution.

Moreover, the electrode material of the present invention is not limited to the one consisting only of a heat resistant element, Cr and Cu. The addition of an element for improving the characteristics of the electrode material is also acceptable. For example, the addition of Te can improve the welding resistance of the electrode material.

The invention claimed is:

1. A process for producing an electrode material, comprising the steps of:

subjecting a molded body or a sintered body of the molded body to a hot isostatic pressing treatment to produce a porous body having a degree of filling of 70% or more, the molded body comprising a Cr powder and a heat resistant element powder including at least one heat resistant element selected from the group consisting of Mo, W, Ta, Nb, V and Zr, wherein an amount of the heat resistant element powder is 13 to 94 wt % of the electrode material and an amount of the Cr powder is 0.65 to 76 wt % of the electrode material; and infiltrating the porous body with Cu and/or Ag in an amount of 5 to 35 wt % relative to the electrode material.

2. The process for producing the electrode material, as claimed in claim 1, further comprising a step of press molding a mixed powder comprising the heat resistant element powder and the Cr powder to obtain the molded body.

3. The process for producing the electrode material, as claimed in claim 1, wherein the heat resistant element powder has an average particle diameter of 2 to 20 μm.

4. The process for producing the electrode material, as claimed in claim 1, wherein the heat resistant element powder has an average particle diameter of 2 to 10 μm.

5. The process for producing the electrode material, as claimed in claim 1, wherein the amount of the heat resistant element powder is 35 to 92 wt % of the electrode material.

6. The process for producing the electrode material, as claimed in claim 1, wherein the amount of the Cr powder is 0.7 to 46 wt % of the electrode material.

7. The process for producing the electrode material, as claimed in claim 1, wherein the Cr powder has a particle diameter of less than 300 μm.

8. The process for producing the electrode material, as claimed in claim 1, wherein the Cr powder has a particle diameter of less than 150 μm.

9. The process for producing the electrode material, as claimed in claim 1, wherein the Cr powder has a particle diameter of less than 45 μm.

10. The process for producing the electrode material, as claimed in claim 1, wherein the infiltrating step comprises infiltrating the porous body with Cu and/or Ag in the amount of 7.5 to 30 wt % relative to the electrode material.

11. The process for producing the electrode material, as claimed in claim 2, wherein the step of press molding the mixed powder is performed at a molding pressure of 2 to 4.5 $t/cm^2$.

12. The process for producing the electrode material, as claimed in claim 1, wherein the hot isostatic pressing treatment comprises a treatment temperature of 700 to 1100° C., a treatment pressure of 30 to 100 MPa, and a treatment time of 1 to 5 hours.

13. The process for producing the electrode material, as claimed in claim 1, wherein the heat resistant element powder includes Mo; and the infiltrating step comprises infiltrating the porous body with Cu.

* * * * *